US006742206B1

(12) United States Patent
Han

(10) Patent No.: US 6,742,206 B1
(45) Date of Patent: Jun. 1, 2004

(54) NURSE ROBOT

(76) Inventor: Tai-Kang Han, 2F, No. 12, Lane 366, Ta-Ming Rd., Tali City, Taichung Hsein (TW)

( * ) Notice: Subject to any disclaimer, the term of this patent is extended or adjusted under 35 U.S.C. 154(b) by 0 days.

(21) Appl. No.: 10/405,492

(22) Filed: Apr. 3, 2003

(51) Int. Cl.[7] ..... A61G 7/015; A61G 7/018

(52) U.S. Cl. ..... 5/618; 5/86.1; 5/85.1; 297/70; 297/75; 297/354.13; 297/362.11; 280/250.1

(58) Field of Search ..... 5/618, 86.1, 85.1, 5/616, 614, 613, 600; 297/354.13, 70, 68, 69, 75, 362.11, DIG. 4; 280/250.1

(56) References Cited

U.S. PATENT DOCUMENTS 2,607,929 A * 8/1952 Balluff ..... 5/618
2,682,913 A * 7/1954 Scmedr ..... 5/618
2,869,614 A * 1/1959 Wamslry ..... 5/618
4,193,147 A * 3/1980 Fischer ..... 5/86.1
4,691,962 A * 9/1987 Holdt ..... 297/DIG. 4
4,862,529 A * 9/1989 Peck ..... 5/618
5,042,487 A * 8/1991 Marquardt ..... 5/618
5,342,114 A * 8/1994 Burke et al. ..... 297/354.13
5,868,461 A * 2/1999 Brotherston ..... 5/618

* cited by examiner

*Primary Examiner*—Alexander Grosz
(74) *Attorney, Agent, or Firm*—Bacon & Thomas, PLLC; Felix J. D'Ambrosio

(57) ABSTRACT

A nurse robot has a stand and a supporting assembly. The supporting assembly is mounted on the stand and has a seat, a backrest, a leg plate, step plate, a first driving device and a second driving device. The seat is attached to the stand. The backrest is pivotally attached to one end of the seat plate. The leg plate is pivotally attached to the other end of the seat. The step plate is pivotally attached to the other end of the leg plate. The first driving device is attached to the seat to drive the backrest and the leg plate to pivotally rotate relative to the seat. The second driving device is attached to the leg plate to drive the step plate to pivotally rotate relative to the leg plate. Accordingly, a patient can conveniently move to any desired place without any other person's help.

7 Claims, 5 Drawing Sheets

NURSE ROBOT

BACKGROUND OF THE INVENTION

1. Field of the Invention

The present invention relates to a nurse robot, and more particularly to a nurse robot which can expand to a bed or be folded to a chair for supporting a patient.

2. Description of Related Art

A patient who cannot move freely always lies on a bed for rest or treatment. When the patient wants to go to outdoors, a wheelchair is used for supporting and transporting the patient. However, a patient cannot move from a bed to a wheelchair by himself or herself. Therefore, a nurse is necessary for taking care of a patient, and this will increase the financial burden to the patient and the family of the patient. In addition, to do anything for the patient involves the participation of someone else which is inconvenient.

The present invention tends to provide a nurse robot to mitigate or obviate the aforementioned problems.

SUMMARY OF THE INVENTION

The main objective of the invention is to provide a nurse robot which can expand to a bed or be folded to a chair for supporting a patient without moving the patient. The nurse robot has a stand and a supporting assembly. The supporting assembly is mounted on the stand and has a seat, a backrest, a leg plate, step plate, a first driving device and a second driving device. The seat is attached to the stand. The backrest is pivotally attached to one end of the seat plate with a first pivot. The leg plate is pivotally attached to the other end of the seat with a second pivot. The step plate is pivotally attached to the other end of the leg plate with a third pivot. The first driving device is attached to the bottom of the seat and has two ends respectively connected to the backrest and the leg plate to drive the backrest and the leg plate to pivotally rotate relative to the seat. The second driving device is attached to the bottom of the leg plate to drive the step plate to pivotally rotate relative to the leg plate. Accordingly, the nurse robot can expand to a bed for a patient to lay out on or be folded to a chair for the patient to sit on. The patient can conveniently move to any desired place without any other person's help.

Other objects, advantages and novel features of the invention will become more apparent from the following detailed description when taken in conjunction with the accompanying drawings.

DETAILED DESCRIPTION OF PREFERRED EMBODIMENT

Figure 1:
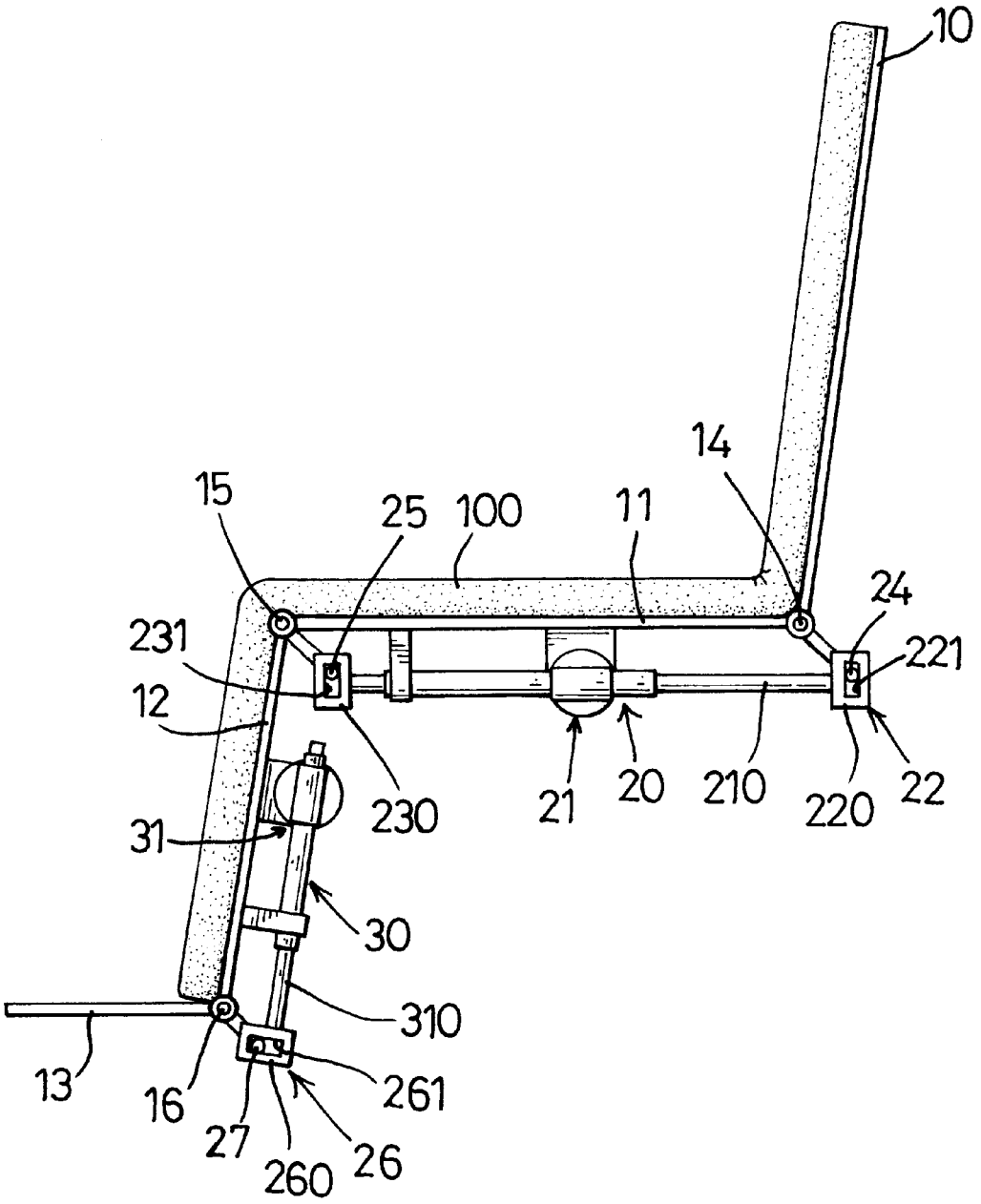
FIG. 1 is a side plan view of a nurse robot in accordance with the present invention.
Figure 5:
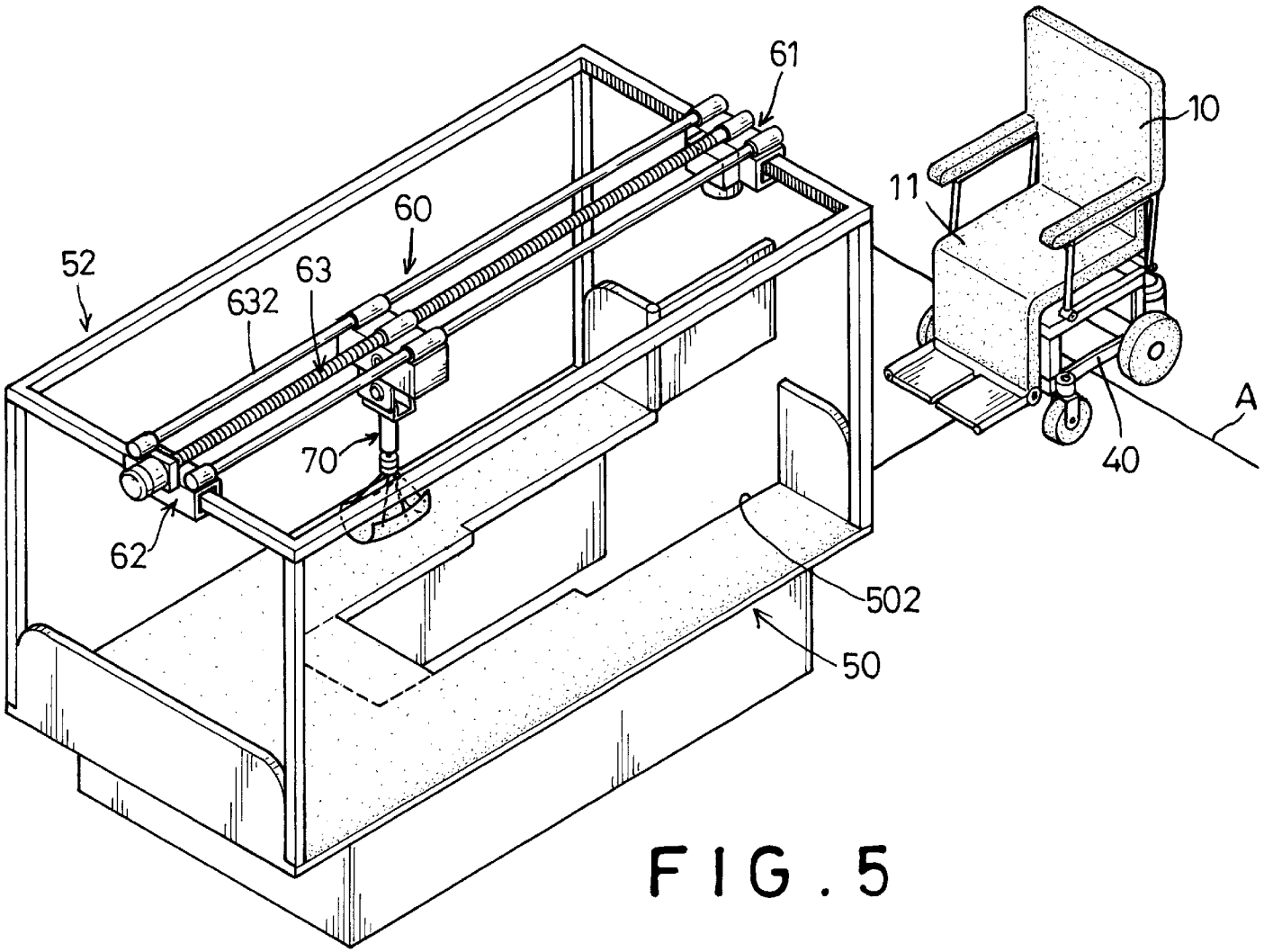
FIG. 5 is an exploded perspective of the hospital bed assembly in FIG. 4 showing that the nurse robot is separated from the hospital bed and in a chair condition for supporting a patient.

With reference to FIGS. 1 and 5, a nurse robot in accordance with the present invention comprises a stand

(40) and a supporting assembly. Multiple wheels (not numbered) are rotatably mounted on the stand (40) for conveniently moving the stand (40). In practice, an electrical driving device is mounted on the stand (40) to drive the wheels to rotate, such that the nurse robot can serve as an electrical wheelchair.

Figure 2:
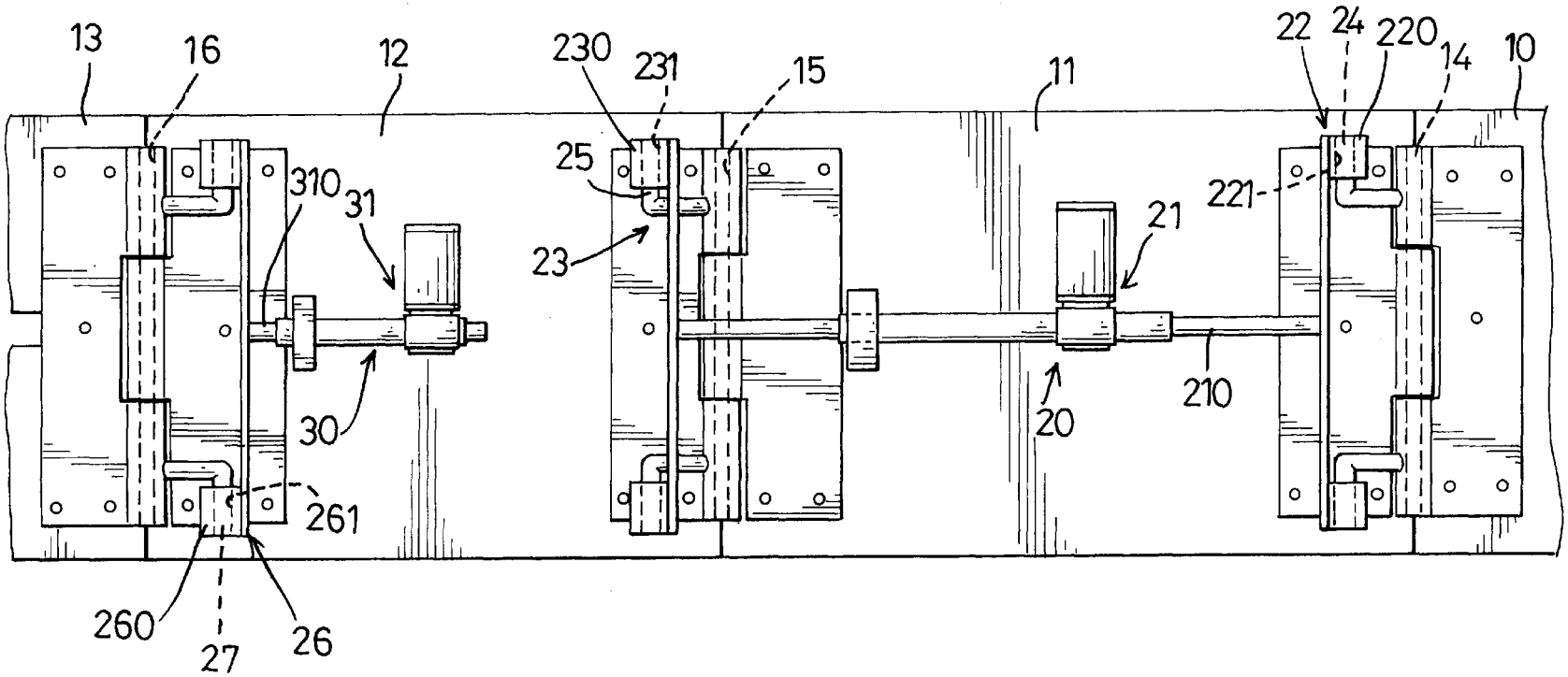
FIG. 2 is a bottom plan view of the nurse robot in FIG. 1.

With further reference to FIGS. 1 and 2, the supporting assembly is mounted on the stand (40) for supporting a patient. The supporting assembly comprises a seat (11), a backrest (10), a leg plate (12), a step plate (13), a first driving device (20) and a second driving device (30). The seat (11) is attached to the stand (40) and has a bottom, a first end and a second end. The backrest (10) is pivotally attached to the first end of the seat (11) with a first pivot (14). The leg plate (12) is pivotally attached to the second end of the seat (11) with a second pivot (15) at a first end of the leg plate (12). A cushion (100) is mounted on the seat (11), the backrest (10) and the leg plate (12) so as to provide a comfortable effect to a person on the supporting assembly. The leg plate (12) has a second end far from the seat (11). The step plate (13) is pivotally attached to the second end of the leg plate (12) with a third pivot (16).

The first driving device (20) is attached to the bottom of the seat (11) and has two ends respectively connected to the backrest (10) and the leg plate (12) to drive the backrest (10) and the leg plate (12) to pivotally rotate relative to the seat (11). The first driving device (20) comprises a first rod (210), an actuating device (21), a first connector (22) and a second connector (23). The first rod (210) is moveably mounted on the bottom of the seat (11) and has two ends respectively extending near the backrest (10) and the leg plate (12). The actuating device (21) is mounted on the bottom of the seat (11) and is connected to the first rod (210) to move the first rod (210) relative to the seat (11). In practice, the actuating device (21) substantially comprises a motor (not numbered), a transmission device (not shown) and a sleeve (not numbered). The motor is attached to the bottom of the seat (11). The sleeve is rotatably mounted on the bottom of the seat (11) and is driven by the motor through the transmission device. The sleeve has an inner thread defined through the sleeve. The first rod (210) penetrates through the sleeve and has an outer thread engaging with the inner threaded in the sleeve. When the motor is switched on, the sleeve will be rotated relative to the seat (11). With the engagement between the inner thread in the sleeve and the outer thread on the first rod (210), the first rod (210) will move relative to the seat (11) in a line. In another embodiment, the actuating device is a pneumatic or a hydraulic cylinder connected to the first rod (210) to actuate the first rod (210) to move in a line.

The first and the second connectors (22,23) are respectively attached to two ends of the first rod (210) and are respectively pivotally attached to the backrest (10) and the leg plate (12). In practice, the first connector (22) comprises a first bar (not numbered), two first sockets (220) and two first connecting rods (24). The first bar is perpendicularly attached at a middle thereof to one end of the first rod (210). Each first socket (220) has a slot (221) and is mounted on a respective end of the first bar. Each first connecting rod (24) is L-shaped and has a first end pivotally and moveably inserted into the slot (221) of a corresponding one of the first sockets (220) and a second end securely attached to the backrest (10).

The second connector (23) has a structure similar to that of the first connector (22) and comprises a second bar (not numbered), two second sockets (230) and two second connecting rods (25). The second bar is perpendicularly attached at a middle portion thereof to the other end of the rod (210). Each second socket (230) has a slot (231) and is mounted on a respective end of the second bar. Each second connecting rod (25) is L-shaped and has a first end pivotally and moveably inserted into the slot (231) of a corresponding one of the second sockets (230) and a second end securely attached to the leg plate (12).

The second driving device (30) is attached to the bottom of the leg plate (12) to drive the step plate (13) to pivotally rotate relative to the leg plate (12). The second driving device (30) comprises a second rod (310), an actuating device (31) and a third connector (26). The second rod (310) is moveably mounted on the bottom of the leg plate (12) and has a driving end extending near the step plate (13). The actuating device (31) is mounted on the bottom of the leg plate (12) and is connected to the second rod (310) to move the second rod (310) relative to the leg plate (12). In practice, the actuating device (31) substantially comprises a motor (not numbered), a transmission device (not shown) and a sleeve (not numbered). The motor is attached to the bottom of the leg plate (12). The sleeve is rotatably mounted on the bottom of the leg plate (12) and is driven by the motor through the transmission device. The sleeve has an inner thread defined through the sleeve. The second rod (310) penetrates through the sleeve and has an outer thread engaging with the inner threaded in the sleeve. When the motor is switched on, the sleeve will be rotated relative to the leg plate (12). With the engagement between the inner thread in the sleeve and the outer thread on the second rod (310), the second rod (310) will move relative to the leg plate (12) in a line. In another embodiment, the actuating device is a pneumatic or a hydraulic cylinder connected to the second rod (310) to actuate the second rod (310) to move in a line.

The third connector (26) is attached to the driving end of the second rod (310) and is pivotally attached to the step plate (12). The third connector (26) has a structure similar to that of the first connector (22) and comprises a third bar (not numbered), two third sockets (260) and two third connecting rods (27). The third bar is perpendicularly attached at a middle portion thereof to the driving end of the second rod (310). Each third socket (260) has a slot (261) and is mounted on a respective end of the third bar. Each third connecting rod (27) is L-shaped and has a first end pivotally and moveably inserted into the slot (261) of a corresponding one of the sockets (260) and a second end securely attached to the step plate (13).

Figure 3:
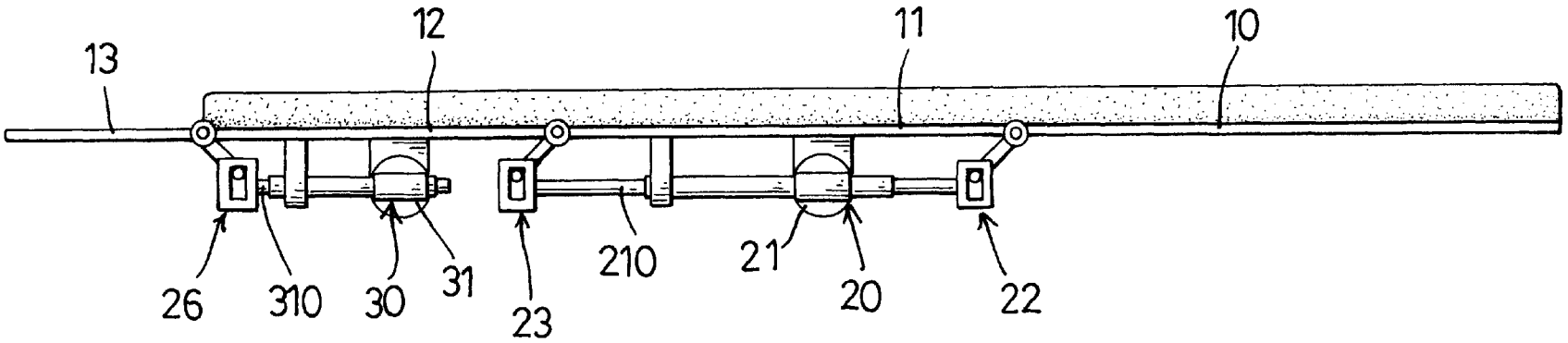
FIG. 3 is an operational side plan of the nurse robot in FIG. 1 showing that the nurse robot is in an expanded condition to serve as a bed for a patient laying down.

With reference to FIGS. 1 to 3, when the first rod (210) of the first driving device (20) is actuated to move relative to the seat (11), the backrest (10) and the leg plate (12) will be rotated relative to the seat (11) in a same direction. For example, when the second rod (210) of the first driving device (20) is moved to a right direction along the drawings, the backrest (10) and the leg plate (12) will be actuated to rotate relative to the seat (11) counterclockwise. Consequently, the backrest (10) will be lifted up and the leg plate (12) will be put down relative to the seat (11). In the meantime, the second rod (310) of the second driving device (30) is moved to rotate the step plate (13) relative to the leg plate (12) to a position where the step plate (13) is substantially perpendicular to the leg plate (12). Accordingly, the nurse robot can be folded to a chair for a patient to sit on. With the wheels on the stand (40), with further reference to FIG. 5, the nurse robot can carry the patient to any desired place.

When the first rod (210) of the first driving device (20) is moved in reverse, the backrest (10) and the leg plate (12) will rotate to a position where the backrest (10) and the leg plate (12) are flush with the seat (11) as shown in FIG. 3. The second rod (310) of the second driving device (30) is also moved in reverse to move the step plate (13) flush with the leg plate (12). Accordingly, the supporting assembly is expanded to an extended condition, and the nurse robot can serve as a bed for a patient to lay on.

Figure 4:
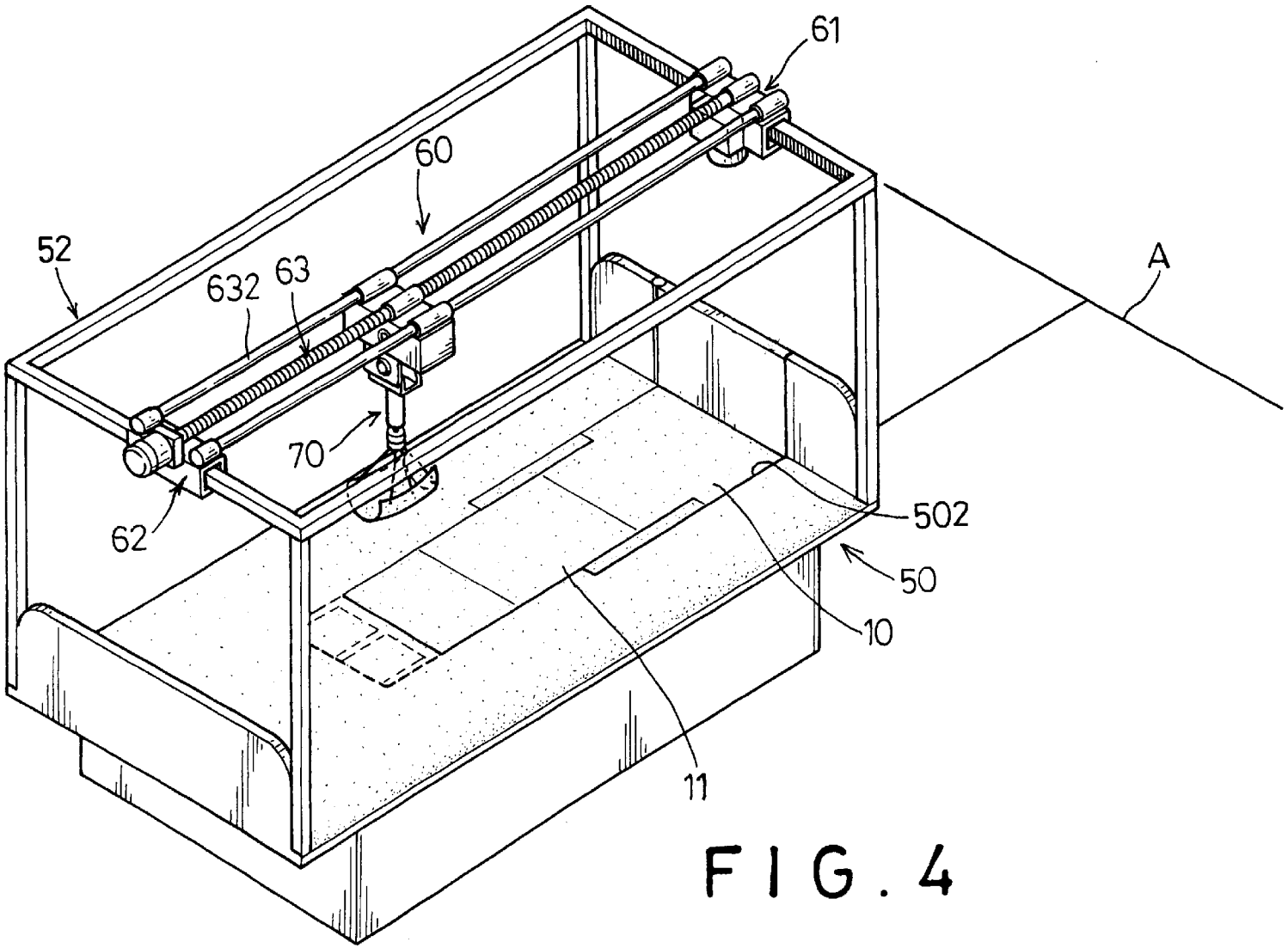
FIG. 4 is a perspective view of a hospital bed assembly with the nurse robot in FIG. 1.

With reference to FIGS. 1, 4 and 5, the nurse robot can be fitted with a hospital bed assembly (50). The nurse robot can be fitted into an aperture (502) defined in a hospital bed when the nurse robot is expanded to an extended condition as shown in FIG. 3. The patient can rest or be treated on the hospital bed combined with the nurse robot.

When the patient wants to go outdoors or to another treatment room, the patient only needs to push a button on a control device which is electrically connected to the driving devices (20,30) on the nurse robot. The nurse robot will be folded to a chair, and the patient can move to any desired place with the chair-type nurse robot. Consequently, the patient can go to any desired place without any other person's help.

For a hospital, as shown in FIG. 5 a guiding system (A) can be mounted on the floor of the hospital and is electrically connected to the nurse robot on each respective hospital bed assembly (50) in the hospital. A computer system (not shown) is electrically connected to the guiding system (A). The computer system can control each nurse robot to serve as a bed or a chair through the guiding system (A). The nurse robot can be moved to any desired place through the guiding system (A), such as another treatment room or outdoors, such that the nurse robot can automatically transport a seriously incapacitated patient who cannot operate the nurse robot without any help from nursing staff.

In practice, a treatment and hoist assembly. (60) is mounted on the hospital bed assembly with the nurse robot in accordance with the present invention. The treatment and hoist assembly (60) substantially comprises a frame (52), a driving assembly (61), a driven assembly (62), a connecting rod (63) and a hoist device (70). The frame (52) is attached to the top of the hospital bed. The driving assembly (61) and the driven assembly (62) are respectively moveably attached opposite sides of the frame (52). The connecting rod (63) is mounted between the driving assembly (61) and the driven assembly (62). The connecting rod (63) is threaded and is driven by a motor mounted on the driven assembly (62). Two guide rods (632) are mounted between the driving assembly (61) and the driven assembly (62) and are parallel to the threaded connecting rod (63). The hoist device (70) is moveably on the connecting rod (63) and the guiding rods (632). Accordingly, the hoist device (70) can move over the hospital bed for treating or recovering the patient lying on the nurse robot. The use of the nurse robot in accordance with the present invention is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A nurse robot comprising:

a stand with wheels; and a supporting assembly mounted on the stand and having a seat attached to the stand and having a bottom, a first end and a second end;

a backrest with a bottom pivotally attached to the first end of the seat with a first pivot;

a leg plate pivotally attached to the second end of the seat with a second pivot at a first end of the leg plate and having a bottom and a second end far from the seat;

a step plate with a bottom pivotally attached to the second end of the leg plate with a third pivot;

a first driving device attached to the bottom of the seat and having two ends respectively connected to the backrest and the leg plate to drive the backrest and the leg plate to pivotally rotate relative to the seat; and a second driving device attached to the bottom of the leg plate to drive the step plate pivotally rotate relative to the leg plate.

2. The nurse robot as claimed in claim 1, wherein the first driving device comprises:

a first rod moveably mounted on the bottom of the seat and having two ends respectively extending near the backrest and the leg plate;

a first actuating device mounted on the bottom of the seat and connected to the first rod to move the first rod relative to the seat; and a first connector and a second connector respectively attached to two ends of the first rod and respectively pivotally attached to the backrest and the leg plate.

3. The nurse robot as claimed in claim 2, wherein the first connector comprises:

a first bar with two ends and perpendicularly attached to one end of the first rod;

two first sockets, each first socket with a slot and respectively mounted on the ends of the first bar; and two L-shaped first connecting rods each having a first end pivotally and moveably inserted into the slot of a respective one of the first sockets and a second end securely attached to the backrest.

4. The nurse robot as claimed in claim 2, wherein the second connector comprises:

a second bar with two ends and perpendicularly attached to one end of the first rod;

two second sockets, each second socket with a slot and respectively mounted on end of the second bar; and two L-shaped second connecting rods each having a first end pivotally and moveably inserted into the slot of a respective one of the second sockets and a second end securely attached to the leg plate.

5. The nurse robot as claimed in claim 1, wherein the second driving device comprises:

a second rod moveably mounted on the bottom of the leg plate and having a driving end extending near the step plate;

a second actuating device mounted on the bottom of the seat and connected to the second rod to move the second rod relative to the seat; and a second connector attached to the driving end of the second rod and pivotally attached to the step plate.

6. The nurse robot as claimed in claim 5, wherein the second connector of the second driving device comprises:

a third bar with two ends and perpendicularly attached to the driving end of the second rod;

two third sockets, each third socket with a slot and mounted on a respective end of the third bar; and two L-shaped third connecting rods each having a first end pivotally and moveably inserted into the slot of a respective one of the third sockets and a second end securely attached to the step plate.

7. The nurse robot as claimed in claim 1 further comprising a cushion mounted on the seat, the backrest and the leg plate.

* * * * *